US010180046B2

(12) United States Patent
Werries et al.

(10) Patent No.: US 10,180,046 B2
(45) Date of Patent: Jan. 15, 2019

(54) DOWNHOLE FLOW CONTROL APPARATUS WITH SCREEN

(71) Applicant: NCS MULTISTAGE INC., Calgary (CA)

(72) Inventors: Michael John Werries, Calgary (CA); John Edward Ravensbergen, Calgary (CA); Don Getzlaf, Calgary (CA); Doug Brunskill, Calgary (CA); Nick Getzlaf, Calgary (CA)

(73) Assignee: NCS MULTISTAGE INC., Calgary (CA)

( * ) Notice: Subject to any disclaimer, the term of this patent is extended or adjusted under 35 U.S.C. 154(b) by 254 days.

(21) Appl. No.: 14/978,102

(22) Filed: Dec. 22, 2015

(65) Prior Publication Data

US 2016/0273319 A1 Sep. 22, 2016

Related U.S. Application Data

(60) Provisional application No. 62/095,936, filed on Dec. 23, 2014.

(51) Int. Cl.

| | |
|---|---|
| ***E21B 43/08*** | (2006.01) |
| ***E21B 34/06*** | (2006.01) |
| ***E21B 43/12*** | (2006.01) |
| ***E21B 23/00*** | (2006.01) |
| ***E21B 43/02*** | (2006.01) |
| *E21B 34/00* | (2006.01) |
| *E21B 33/12* | (2006.01) |
| *E21B 43/16* | (2006.01) |

(52) U.S. Cl.

CPC ..... *E21B 43/08* (2013.01); *E21B 23/006* (2013.01); *E21B 34/06* (2013.01); *E21B 43/02* (2013.01); *E21B 43/12* (2013.01); *E21B 33/12* (2013.01); *E21B 43/082* (2013.01); *E21B 43/16* (2013.01); *E21B 2034/007* (2013.01)

(58) Field of Classification Search

CPC ..... E21B 43/08; E21B 43/12; E21B 43/082; E21B 43/16; E21B 23/006; E21B 34/06; E21B 33/12; E21B 2034/007

See application file for complete search history.

(56) References Cited

U.S. PATENT DOCUMENTS

| | | | |
|---|---|---|---|
| 7,387,165 | B2 | 6/2008 | Lopez de Cardenas et al. |
| 7,793,716 | B2 | 9/2010 | Macias et al. |
| 8,127,847 | B2 | 3/2012 | Richard et al. |

(Continued)

FOREIGN PATENT DOCUMENTS

| | | | |
|---|---|---|---|
| EP | 0427422 | A2 | 5/1991 |
| EP | 1423583 | B1 | 3/2006 |
| WO | 20080154184 | A2 | 12/2008 |

OTHER PUBLICATIONS

WIPO, International Search Report and Written Opinion for PCT Application No. PCT/CA2015/000608 dated Mar. 23, 2016.

(Continued)

*Primary Examiner* — D. Andrews
*Assistant Examiner* — Yanick A Akaragwe
(74) *Attorney, Agent, or Firm* — Ridout & Maybee LLP

(57) ABSTRACT

A flow control apparatus is provided for deployment downhole as part of a wellbore string. The flow control apparatus includes a flow control member having a screened portion for filtering debris from reservior fluid that is incoming into the wellbore.

36 Claims, 9 Drawing Sheets

(56) References Cited

U.S. PATENT DOCUMENTS

| | | | | |
|---|---|---|---|---|
| 8,291,982 | B2 | 10/2012 | Murray et al. | |
| 8,297,358 | B2 | 10/2012 | Korkmaz et al. | |
| 2004/0129424 | A1 | 7/2004 | Hosie et al. | |
| 2004/0238173 | A1* | 12/2004 | Bissonnette | E21B 34/14 166/307 |
| 2009/0044944 | A1 | 2/2009 | Murray et al. | |
| 2009/0056934 | A1 | 3/2009 | Xu | |
| 2012/0080188 | A1 | 4/2012 | Richard et al. | |
| 2012/0186803 | A1 | 7/2012 | Xu et al. | |
| 2012/0325466 | A1 | 12/2012 | Themig | |
| 2012/0325500 | A1 | 12/2012 | Moen | |
| 2013/0228341 | A1* | 9/2013 | Fripp | E21B 43/12 166/373 |
| 2013/0319687 | A1 | 12/2013 | Huh et al. | |
| 2014/0014347 | A1 | 1/2014 | Adam et al. | |

OTHER PUBLICATIONS

Geddes, Martin, Fifteen Years of Expandable Sand Screen (ESS) Performance and Reliability, Mar. 27, 2014, presented at the 6th European Sand Management Forum, Weatherford.

Extended European Search Report issued in EP 15871380 dated Sep. 18, 2018.

* cited by examiner 10
11B
11A
12
14
16
18
20
22
22A
22B
32
34
36
38
40

DOWNHOLE FLOW CONTROL APPARATUS WITH SCREEN

FIELD

The present disclosure relates to apparatuses which are deployable downhole for controlling supply of treatment fluid to the reservoir and for controlling production of reservoir fluids from the reservoir.

BACKGROUND

Production of hydrocarbon reservoirs is complicated by the presence of naturally-occurring solids debris, such as sand, as well as solids, such as proppant, which have been intentionally injected into the reservoir, in conjunction with treatment fluid, for improving the rate of hydrocarbon production from the reservoir.

SUMMARY

In one aspect, there is provided an apparatus comprising: a housing including a port, a third position-determining hard stop, and a passage; a hard stop engager; and a flow control member including a screen, wherein the flow control member is:

displaceable relative to the port, wherein the displaceability includes:

displaceability, relative to the port, by a first displacement from a first position, corresponding to disposition of the port in a closed condition, to a second position, corresponding to disposition of the port in an open condition;

and displaceability, relative to the port, by a second displacement from the second position to a third position corresponding to disposition of the port in a screened condition, wherein, in the screened condition, at least a portion of the screen is disposed in alignment with the port such that the port is obstructed, or substantially obstructed by the at least a screen portion, and such that the at least a screen portion is disposed for interfering with conduction of oversize solids through the port; configured for becoming coupled to the hard stop engager during the displacement of the flow control member relative to the port, wherein the coupling of the flow control member to the hard stop engager is such that the hard stop engager translates with the flow control member with effect that the displaceability of the flow control member, relative to the port, becomes limited by the third position-determining hard stop, in response to engagement of the hard stop engager with the third position-determining hard stop, such that, upon the engagement of the hard stop engager with the third position-determining hard stop, the flow control member becomes disposed in the third position.

In another aspect, there is provided an apparatus comprising:

a housing including a port, a hard stop, and a passage;

a flow control member including a screen and a j-slot;

wherein:

the flow control member is displaceable, relative to the port, such that the flow control member is positionable, relative to the port, in a first position, corresponding to disposition of the port in a closed condition, a second position, corresponding to disposition of the port in an open condition, and a third position, corresponding to disposition of the port in a screened condition, wherein, in the screened condition, at least a portion of the screen is disposed in alignment with the port such that the port is obstructed, or substantially obstructed by the at least a screen portion, and such that the at least a screen portion is disposed for interfering with conduction of oversize solids through the port;

the hard stop is disposed within the j-slot and is displaceable, relative to the flow control member, while the flow control member is being displaced, relative to the port, and co-operates with the j-slot such that displacement of the flow control member is limited such that at least one of the first, second and third positions of the flow control member is established by the limiting of the displacement of the flow control member by the interaction between the hard stop and the j-slot.

In another aspect, there is provided an apparatus comprising:

a housing including a port and a passage;

a first flow control member displaceable relative to the port between a closed port condition-defining position and a non-closed port condition-defining position; and a second flow control member including a screen, and positionable in a screened port condition-defining position;

wherein the first flow control member co-operates with the second flow control member such that: (i) disposition of the first flow control member in the closed port condition-defining position is conditional on the second flow control member being disposed in a retracted position relative to the screened port condition-defining position, and the disposition of the first flow control member in the closed port condition-defining position corresponds to the port being disposed in the closed condition, (ii) disposition of the second flow control member in the screened port condition-defining position is conditional on the first flow control member being disposed in a retracted position relative to the closed port condition-defining position, and the disposition of the second flow control member in the screened port condition-defining position corresponds to the port being disposed in the screened condition, and (iii) while the first flow control member is disposed in the non-closed port condition-defining position and the second flow control member is disposed in a retracted position relative to the screened port condition-defining position, the port is disposed in an open condition.

In another aspect, there is provided a method of producing hydrocarbon material from a subterranean formation, comprising:

deploying a wellbore string within a wellbore that extends into a subterranean formation, wherein the wellbore string includes an apparatus comprising a housing and a flow control member;

wherein:

the housing includes a port and a passage;

the flow control member including a screen;

the flow control member is displaceable, relative to the port, such that the flow control member is positionable, relative to the port, in a first position, corresponding to disposition of the port in a closed condition, a second position, corresponding to disposition of the port in an open condition, and a third position, corresponding to disposition of the port in a screened condition, wherein, in the screened condition, at least a portion of the screen is disposed in alignment with the port such that the port is obstructed, or substantially obstructed by the at least a screen portion, and such that the at least a screen portion is disposed for interfering with conduction of oversize solids through the port;

and after the deploying, displacing the flow control member to one of the first, second and third positions with a conveyance mechanism that is configured to controllably displace the shifting tool by a predetermined distance.

BRIEF DESCRIPTION OF DRAWINGS

The preferred embodiments will now be described with the following accompanying drawings, in which.

DETAILED DESCRIPTION

Figures 1, 2, 3:
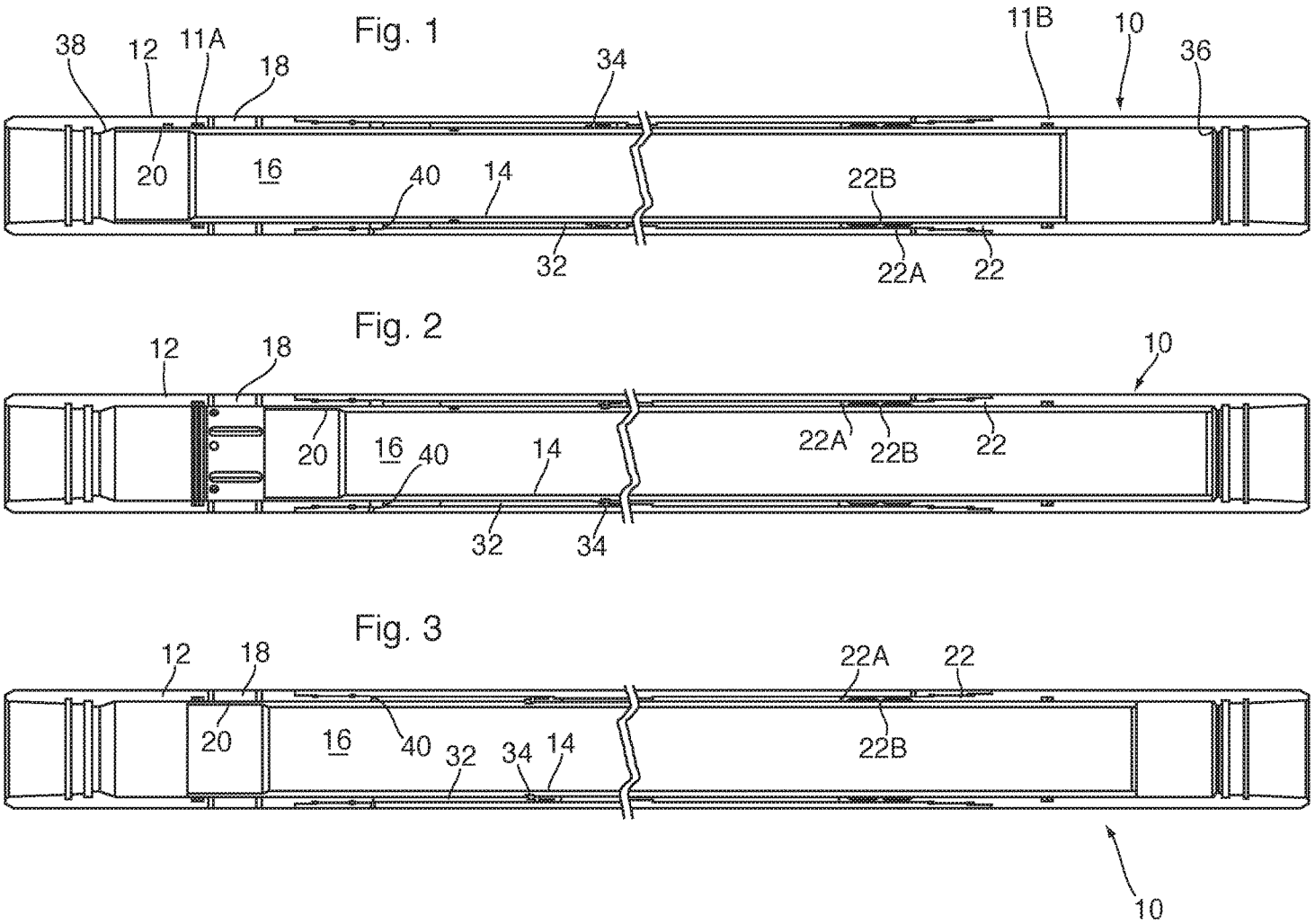
FIG. 1 is a sectional view of a first embodiment of the apparatus, showing the port disposed in the closed condition.
FIG. 2 is a sectional view of the apparatus illustrated in FIG. 1, showing the port disposed in the open condition and the flow control member being coupled to the hard stop engager, with the flow control member having moved downhole from its position in FIG. 1 to effect opening of the port and coupling of the flow control member with the hard stop engager.
FIG. 3 is a sectional view of the apparatus illustrated in FIG. 1, showing the port disposed in the screened position; with the flow control member having moved uphole from its position in FIG. 2.

There is provided an apparatus 10 for selectively stimulating a reservoir, and for effecting production of hydrocarbon material from the stimulated reservoir. The apparatus is deployable within a wellbore 8. Suitable wellbores include vertical, horizontal, deviated or multi-lateral wells. The wellbore extends into a subterranean formation The reservoir is stimulated by supplying treatment material to the subterranean formation 100 which includes the reservoir.

In some embodiments, for example, the treatment material is a liquid including water and chemical additives. In other embodiments, for example, the treatment material is a slurry including water, proppant, and chemical additives. Exemplary chemical additives include acids, sodium chloride, polyacrylamide, ethylene glycol, borate salts, sodium and potassium carbonates, glutaraldehyde, guar gum and other water soluble gels, citric acid, and isopropanol. In some embodiments, for example, the treatment material is supplied to effect hydraulic fracturing of the reservoir.

In some embodiments, for example, the treatment material includes water, and is supplied to effect waterflooding of the reservoir.

The apparatus 10 may be deployed within the wellbore and integrated within a wellbore string 11.

Successive apparatuses 10 may be spaced from each other such that each apparatus is positioned adjacent a producing interval to be stimulated by fluid treatment effected by treatment material that may be supplied through a port 18 (see below).

Referring to FIGS. 1 to 17, in some embodiments, for example, the apparatus 10 includes a housing 12 and a flow control member 14. The housing 12 includes the port 18. The flow control member 14 includes a screen 20.

The screen 20 is configured to interfere with (for example, prevent or substantially prevent) passage of oversize solid material through the port 18. In some embodiments, for example, the screen 20 is machined into the flow control member 14. In some embodiments, for example, the screen 20 is defined by a sand screen that is wrapped around a perforated section of the flow control member 14. In some embodiments, for example, the screen 20 is in the form of a porous material that is integrated within an aperture of the flow control member 14.

Figure 17:
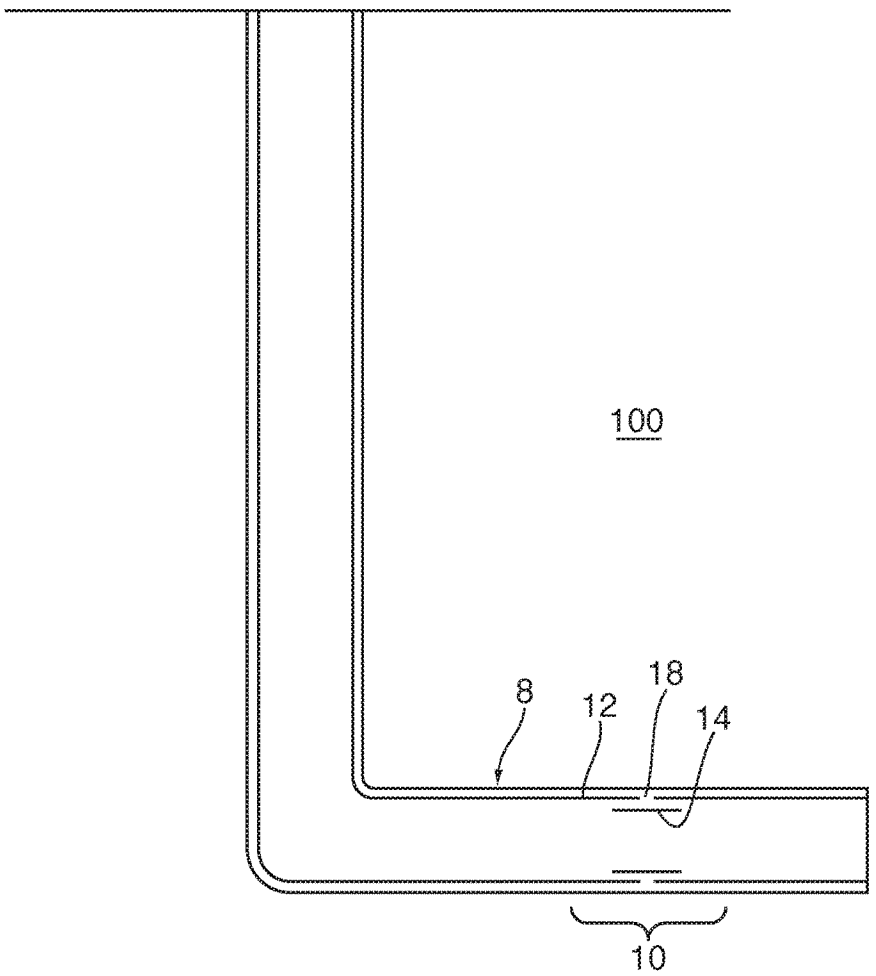
FIG. 17 is a schematic illustration of the apparatus disposed within a wellbore.

Referring to FIG. 17, the housing 12 is coupled (such as, for example, threaded) to the wellbore string 11. The wellbore string is lining the wellbore 8. The wellbore string 11 is provided for, amongst other things, supporting the subterranean formation 100 within which the wellbore 8 is disposed. The wellbore string 11 may include multiple segments, and segments may be connected (such as by a threaded connection). In some embodiments, for example, the wellbore string includes a casing string.

A passage 16 is defined within the housing 12. The passage 16 is configured for conducting treatment material from a supply source (such as at the surface) to the port 18 such that the treatment material is able to be supplied to the subterranean formation 100.

In some embodiments, for example, the housing 12 includes a sealing surface configured for sealing engagement with the flow control member 14. In some embodiments, for example, the sealing surface is defined by sealing member 11A, 11B. In some embodiments, for example, when the flow control member 14 is disposed in a position corresponding to the closed position of the port 18, each one of the sealing members 11A, 11B, is, independently, disposed in sealing engagement with both of the housing 12 and the flow control member 14.

In some embodiments, for example, each one of the sealing members 11A, 11B, independently, includes an o-ring. In some embodiments, for example, the o-ring is housed within a recess formed within the housing 12. In some embodiments, for example, each one of the sealing members 11A, 11B, independently, includes a molded sealing member (i.e. a sealing member that is fitted within, and/or bonded to, a groove formed within the sub that receives the sealing member).

The port 18 extends through the housing 12, and is disposed between the sealing surfaces 11A, 11B. In some embodiments, for example, the port 18 extends through the housing 12. During treatment, the port 18 effects fluid communication between the passage 16 and the wellbore. In this respect, during treatment, treatment material being conducted from the treatment material source via the passage is supplied to the wellbore through the port.

In some embodiments, for example, the passage 16 is configured to receive a shifting device for actuating movement of the flow control member 14, and thereby effecting a change in the condition of the port 18.

Referring to FIG. 17, in some embodiments, for example, it is desirable for the treatment material being supplied to the wellbore through the port 18 be supplied, or at least substantially supplied, within a definite zone (or "interval") of the subterranean formation 100 in the vicinity of the port. In this respect, the system may be configured to prevent, or at least interfere, with conduction of the treatment material, that is supplied to one zone of the subterranean formation, to a remote zone of the subterranean formation. In some embodiments, for example, such undesired conduction to a remote zone of the subterranean formation 100 may be effected through an annulus, that is formed within the wellbore, between the casing and the subterranean formation. To prevent, or at least interfere, with conduction of the supplied treatment material to a zone of interval of the subterranean formation 100 that is remote from the zone or interval of the subterranean formation to which it is intended that the treatment material is supplied, fluid communication, through the annulus, between the port and the remote zone, is prevented, or substantially prevented, or at least interfered with, by a zonal isolation material. In some embodiments, for example, the zonal isolation material includes cement, and, in such cases, during installation of the assembly within the wellbore, the casing string is cemented to the subterranean formation 100, and the resulting system is referred to as a cemented completion.

To at least mitigate ingress of cement during cementing, and also at least mitigate curing of cement in space that is in proximity to the port 18, or of any cement that has become disposed within the port, prior to cementing, the port may be filled with a viscous liquid material having a viscosity of at least 100 $mm^2/s$ at 40 degrees Celsius. Suitable viscous liquid materials include encapsulated cement retardant or grease. An exemplary grease is SKF LGHP 2™ grease. For illustrative purposes below, a cement retardant is described. However, it should be understood, other types of liquid viscous materials, as defined above, could be used in substitution for cement retardants.

In some embodiments, for example, the zonal isolation material includes a packer, and, in such cases, such completion is referred to as an open-hole completion.

The flow control member 14 is displaceable relative to the port 18, and positionable in first, second and third positions. The first position corresponds to a closed condition of the port 18. The second position corresponds to an open condition of the port 18. The third position corresponds to a screened condition of the port 18. In the screened condition, the screen 20 is disposed in alignment with the port 18 such that the port 18 is obstructed, or substantially obstructed by the screen 20, and such that the screen 20 is disposed for interfering with conduction of oversize solids through the port 18.

In some embodiments, for example, the disposition of the flow control member 14 in the first position is such that the flow control member 14 occludes the port. In some embodiments, for example, while the apparatus 10 is disposed within the wellbore and the port 18 is closed, the flow control member 14 prevents, or substantially prevents, conduction of materials through the port 18, between the passage 16 and the subterranean formation.

In some embodiments, for example, the disposition of the flow control member 14 in the second position is such that a continuous portion of the port 18 is unobstructed by the flow control member, wherein the continuous portion defines at least 25% of the total area of the port 18, such as, for example, at least 50% of the total area of the port 18, such as, for example, at least 75% of the total area of the port 18. In some embodiments, for example, it is not necessary that the entirety of the port 18 be unobstructed by the flow control member 14 for the port 18 to be disposed in the open condition. In this respect, in some of these embodiments, for example, the disposition of the flow control member in the second position is such that the flow control member occludes at least 25% of the total area of the port.

In some embodiments, for example, the disposition of the flow control member 14 in the second position is such that the port is non-occluded, or substantially non-occluded, by the flow control member 14.

In some embodiments, for example, the disposition of the flow control member 14 in the second position is such that there is an absence, or substantial absence, of interference by the flow control member 14 with conduction of material through the port 18.

The flow control member 14 is displaceable, relative to the port 18, from the first position to the second position and thereby effect opening of the port 18, for purposes of supplying treatment material to the wellbore through the port 18.

In some embodiments, for example, the flow control member 14 is also displaceable, relative to the port 18, from the second position to the first position to effect re-closing of the port 18. In some embodiments, for example, this is effected after completion of the supplying of the treatment material to the wellbore through the port. In some embodiments, for example, this enables the delaying of production through port, facilitates controlling of wellbore pressure, and also mitigates ingress of sand or other solids from the reservoir into the casing, while other zones of the subterranean formation are now supplied with treatment material through other ports. In this respect, after sufficient time has elapsed after the supplying of the treatment material to a zone of the subterranean formation, such that meaningful fluid communication has become established between the hydrocarbons within the zone of the subterranean formation and the port 18, by virtue of the interaction between the subterranean formation and the treatment material that has been previously supplied into the subterranean formation through the port, and, optionally, after other zones of the subterranean formation have similarly become disposed in fluid communication with other ports, the flow control member(s) may be moved to the second position so as to enable production through the passage.

In some embodiments, for example, by enabling displacement of the flow control member 14, so as to effect opening and closing of the port 18, pressure management during hydraulic fracturing is made possible.

Displacement of the flow control member 14, relative to the port 18, from the second position to the first position, so as to effect closing of the port 18, may also be effected while fluids are being produced from the subterranean formation 100 through the port, and in response to sensing of a sufficiently high rate of water production from the reservoir through the port. In such case, moving the flow control member 14 blocks further production through the associated port 18.

In some embodiments, for example, the passage 16 is being used to supply water for effecting water flooding of the subterranean formation. In such cases, where channeling, within the subterranean formation, is sensed of water being supplied through the port 18, displacing the flow control member 14 from the second position to the first position blocks wasted supply of water through the port.

After the port 18 has been re-closed, the flow control member 14 is displaceable, relative to the port 18, from the first position to the third position so as to effect a change in condition of the port 18 from a closed condition to a screened condition, and thereby enable production of reservoir fluids through the port 18, after sufficient time has been provided for the supplied treatment material to stimulate the reservoir.

The flow control member 14 is also displaceable from the second position to the third position, without, prior to assuming the third position, transitioning to the first position. Such manipulation of the flow control member 14 may be practised when it is desirable to bring on production shortly after a hydraulic fracturing operation.

The flow control member 14 is displaceable, relative to the port 18, from t he first position, corresponding to disposition of the port 18 in the closed condition, to the second position, corresponding to disposition of the port 18 in the open condition, and the displacement of the flow control member 14, relative to the port 18, is limited between these positions, such as by surfaces of the housing 12 which function as separate hard stops 36, 38. When the flow control member 14 is engaged to the hard stop 38 and thereby prevented from displacement in one of an uphole and downhole direction (in the illustrated embodiment, this is the uphole direction), the flow control member 14 is disposed in the first position. When the flow control member 14 is engaged to the hard stop 36, and thereby prevented from displacement in the other one of an uphole and downhole direction (in the illustrated embodiment, this is the downhole direction), the flow control member 14 is disposed in the second position. In this respect, the hard stop 38 determines the first position of the flow control member 14, and the hard stop 36 determines the second position of flow control member 14.

In some embodiments, for example, the flow control member 14 includes a sleeve. The sleeve is slideably disposed within the passage 16.

In some embodiments, for example, the flow control member 14 co-operates with the sealing members 11A, 11B to effect opening and closing of the port 18. In this respect, the flow control member 16 co-operates with the sealing members 11A, 11B. When the port 18 is disposed in the closed position, an unbroken (unperforated) portion of the flow control member is sealingly engaged to both of the sealing surfaces 11A, 11B. When the port 18 is disposed in the open condition, the flow control member 16 is spaced apart or retracted from at least one of the sealing members (such as the sealing surface 11A), thereby providing a fluid passage for treatment material to be delivered to the port 18 from the passage 16. When the port 18 is disposed in the screened condition, the screened portion 20 of the flow control member 14 is disposed in alignment with the port.

In some embodiments, for example, a flow control member-engaging collet 22 extends from the housing 12, and is configured to engage the flow control member 16 for resisting a change in disposition of the flow control member. In this respect, in some embodiments, for example, the flow control member-engaging collet 22 includes at least one resilient flow control member-engaging collet finger 22A, and each one of the at least one flow control member-engaging collet finger includes a tab 22B that engages the flow control member.

In some embodiments, for example, the flow control member 14 and the flow control member-engaging collet 22 are co-operatively configured so that engagement of the flow control member and the flow control member-engaging collet is effected while the port 18 is disposed in the closed condition, the open condition, or the screened condition.

Referring to FIGS. 1, 4, 6, and 8, while the flow control member is disposed in the first position (i.e. the port 18 is disposed in the closed condition) the flow control member-engaging collet 22 is engaging the flow control member 14 such that interference or resistance is being effected to displacement of the flow control member 14. The flow control member 14 includes a closed condition-defining recess 24. The at least one flow control member-engaging collet finger 22A and the recess 24 are co-operatively configured such that while the flow control member 14 is disposed in the first position, the flow control member-engaging collet finger tab 22B is disposed within the closed condition-defining recess 24. In order to effect opening of the port 18, a first displacement force is applied to the flow control member 14 to effect displacement of the tab 22B from (or out of) the recess 24. Such displacement is enabled due to the resiliency of the collet finger 22A. Once the flow control member-engaging collet finger tab 22B has become displaced out of the recess 24, continued application of force to the flow control member 14 (such as, in the embodiments illustrated in FIGS. 1 to 3, in a downhole direction) effects displacement of the flow control member 14, relative to the port 18, such that there is a change in condition of the port 18 from a closed condition to an open condition. In some embodiments (see FIGS. 4 to 7), alternatively, the flow control member 14 is also displaceable from the first position to the third position such that a change in disposition of the port 18 from a closed condition to a screened condition is effected, and in order to effect a change in disposition of the port 18 from a closed condition to a screened condition (such as, for example, when the port 18 has become disposed in the closed condition after treatment material has been injected through the port 18 and into the subterranean formation, and it is desirable to delay production, as described above), a second displacement force is applied to the flow control member 14 to effect displacement of the tab 22B from (or out of) the recess 24, again, owing to to the resiliency of the collet finger 22A. Once the flow control member-engaging collet finger tab 22B has become displaced out of the recess 24, continued application of the second displacement force to the flow control member 14 (such as in a downhole direction, as in the embodiment illustrated in FIGS. 4 to 7) effects displacement of the flow control member 14, relative to the port 18, such that there is a change in condition of the port 18 from a closed condition to a screened condition.

Figures 4, 5, 6, 7:
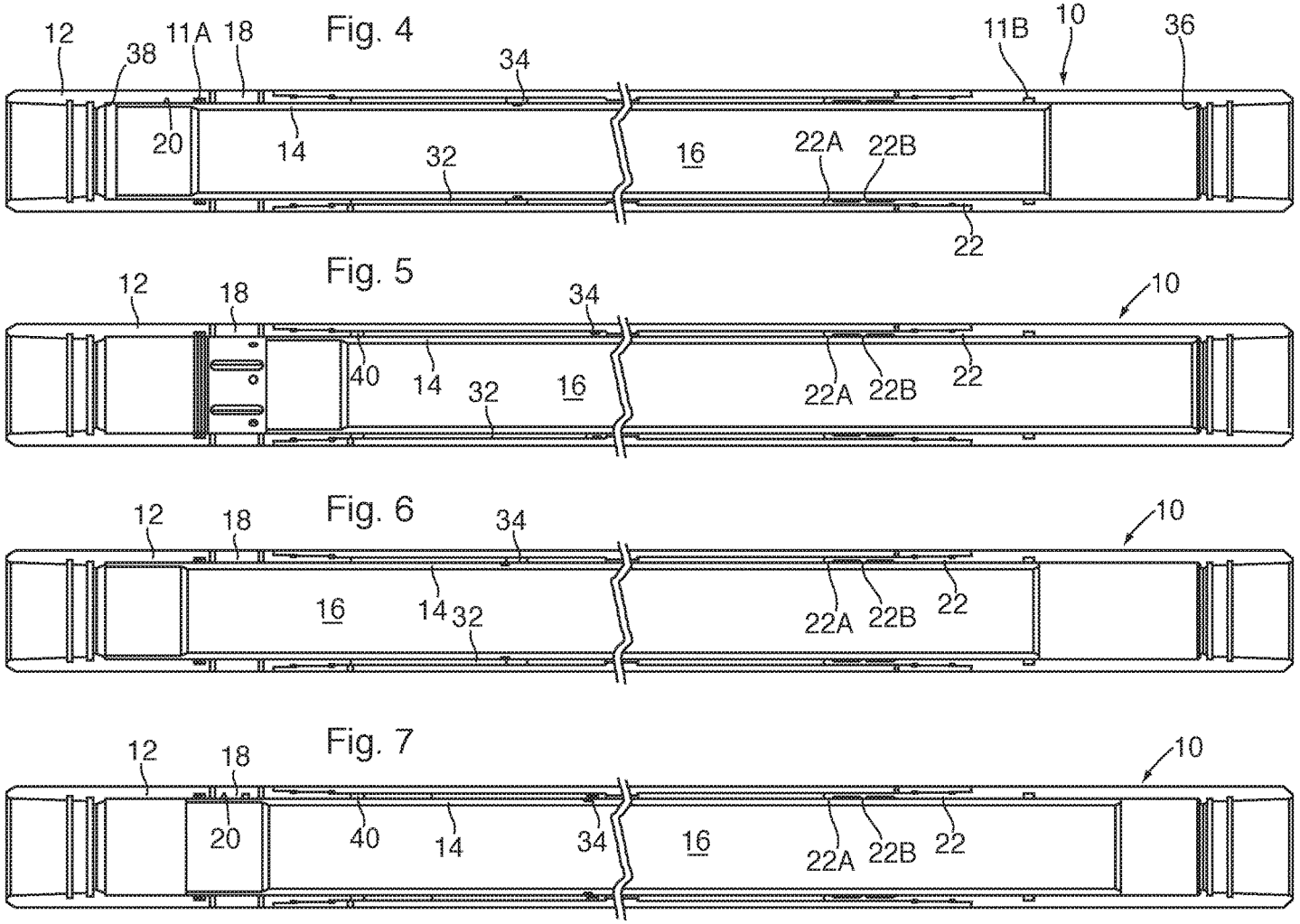
FIG. 4 is a sectional view of a second embodiment of the apparatus, with the port disposed in the closed condition.
FIG. 5 is a sectional view of the apparatus illustrated in FIG. 4, showing the port disposed in the open condition, with the flow control member having moved downhole from its position in FIG. 3 to effect opening of the port.
FIG. 6 is a sectional view of the apparatus illustrated in FIG. 4, showing the port having been re-closed and the flow control member being coupled to the hard stop engager, with the flow control member having moved uphole from its position in FIG. 5 to effect re-closure of the port and the coupling of the flow control member with the hard stop engager.
FIG. 7 is a sectional view of the apparatus illustrated in FIG. 4, showing the port disposed in the screened position; with the flow control member having moved downhole from its position in FIG. 6.
Figures 7A, 7B:
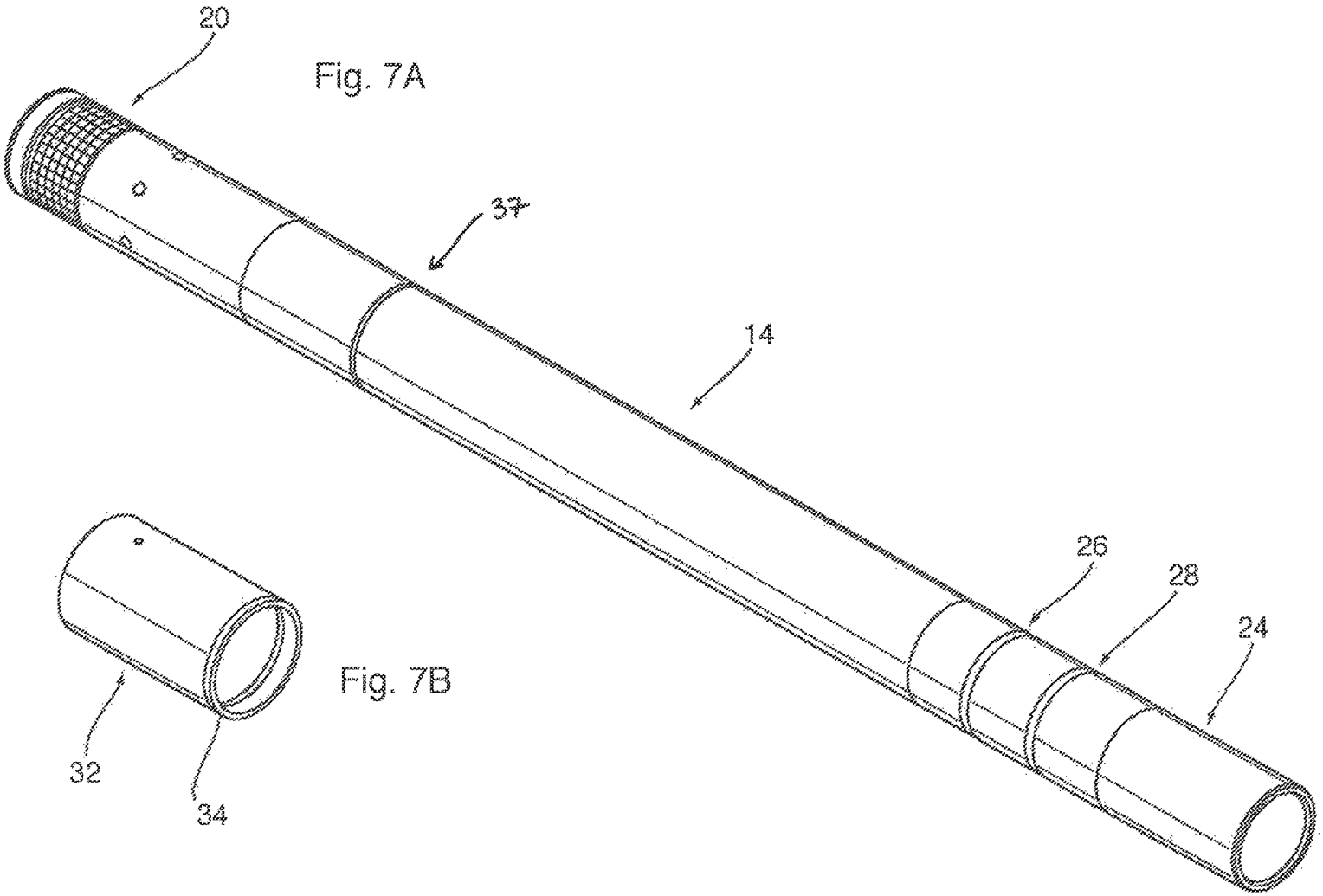
FIG. 7A is a perspective view of the flow control member that is useable with the first embodiment (see FIGS. 1, 2 and 3) and the second embodiment (see FIGS. 4, 5, 6 and 7) of the apparatus.
FIG. 7B is a perspective view of the hard stop engager that is useable with the first embodiment (see FIGS. 1, 2 and 3) and the second embodiment (see FIGS. 4, 5, 6 and 7) of the apparatus.
Figure 9:
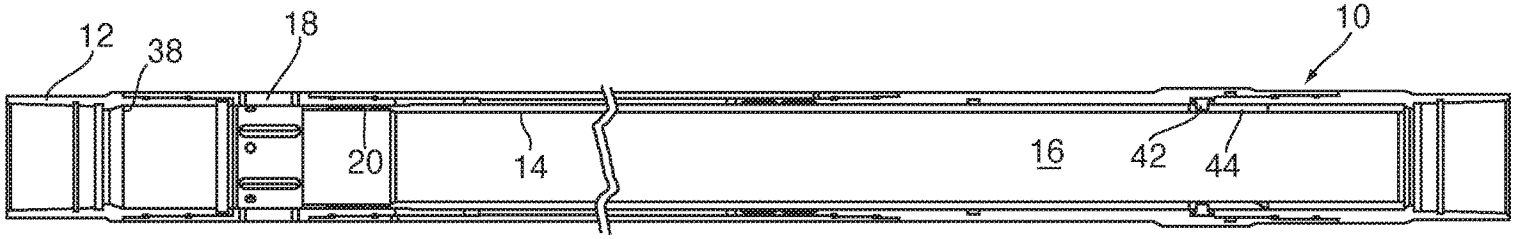
FIG. 9 is a sectional view of the apparatus illustrated in FIG. 8, showing the port disposed in the open position, with the flow control member having moved downhole from its position in FIG. 8 to effect opening of the port.

Referring to FIGS. 2, 5, and 9, while the flow control member is disposed in the second position (i.e. the port 18 is disposed in the open condition), the flow control member-engaging collet 22 is engaging the flow control member 14 such that interference or resistance is being effected to displacement of the flow control member. The flow control member 14 includes an open condition-defining recess 26. The at least one flow control member-engaging collet finger 22A and the recess 26 are co-operatively configured such that while the port 18 is disposed in the open condition, the flow control member-engaging collet finger tab 22B is disposed within the open condition-defining recess 26. In order to effect a change in condition of the port 18 from the open condition, a third displacement force is applied to the flow control member 14 to effect displacement of the tab from (or out of) the recess 26. Such displacement is enabled due to the resiliency of the collet finger 22A. Once the flow control member-engaging collet finger tab 22B has become displaced out of the recess 26, continued application of the third displacement force to the flow control member 14 (such as, in the embodiment illustrated in FIGS. 1 to 3, in an uphole direction) effects displacement of the flow control member 14, relative to the port 18, from the second position to the third position such that there is a change in condition of the port 18 from an open condition to a screened condition. In some embodiments (see FIGS. 4 to 7), for example, alternatively, the flow control member 14 is also displaceable from the second position to the first position to effect re-closure of the port 18 (i.e. a change in disposition of the port 18 from the open condition to the closed condition, such as, for example, for the reasons described above), and in order to effect re-closure of the port 18, a fourth displacement force is applied to the flow control member 14 to effect displacement of the tab 22B from (or out of) the recess 26, again, owing to to the resiliency of the collet finger 22A. Once the flow control member-engaging collet finger tab 22B has become displaced out of the recess 26, continued application of the second displacement force to the flow control member 14 (such as, in the embodiment illustrated in FIGS. 4 to 7, in an uphole direction) effects displacement of the flow control member 14, relative to the port 18, such that there is a change in condition of the port 18 from the open condition to the closed condition.

Figure 10:
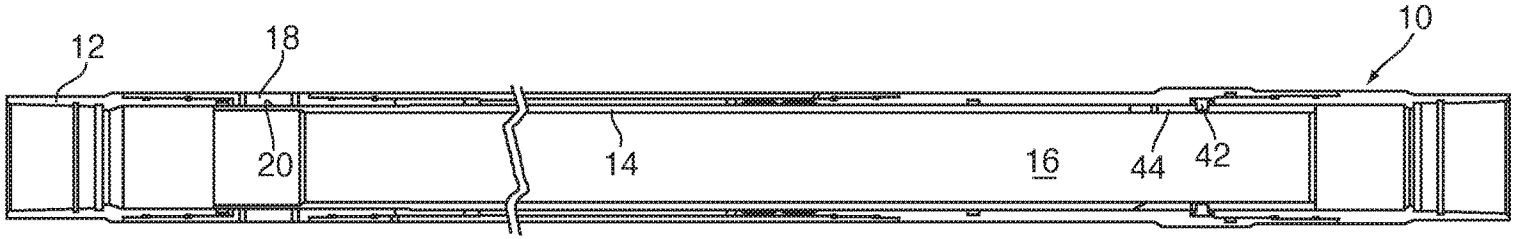
FIG. 10 is a sectional view of the apparatus illustrated in FIG. 8, showing the port disposed in the screened position, with the flow control member having moved uphole from its position in FIG. 9.

Referring to FIGS. 3, 7, and 10, while the flow control member 14 is disposed in the third position (i.e. the port 18 is disposed in the screened condition), the flow control member-engaging collet 22 is engaging the flow control member 14 such that interference or resistance is being effected to displacement of the flow control member 14. The flow control member 14 includes a screened condition-defining recess 28. The at least one flow control member-engaging collet finger 22A and the recess 28 are co-operatively configured such that while the port 18 is disposed in the screened condition, the flow control member-engaging collet finger tab 22B is disposed within the screened condition-defining recess 28. In order to effect a change in condition of the port 18 from the screened condition, a fifth displacement force is applied to the flow control member 14 to effect displacement of the tab 22B from (or out of) the recess 28. Such displacement is enabled due to the resiliency of the collet finger 22A. Once the flow control member-engaging collet finger tab 22B has become displaced out of the recess 28, depending on the configuration of the apparatus (see below), displacement of the flow control member 14, relative to the port 18, in some embodiments, is only effectible such that the port 18 becomes disposed in the closed condition, or, in some embodiments, is only effectible such that the port 18 becomes disposed in the open condition, or, in some embodiment, is effectible such that the port 18 is disposable in either one of the open or closed conditions.

In some embodiments, for example, while the apparatus 10 is being deployed downhole, the flow control member 14 is maintained in a position, by one or more shear pins, such that the port 18 remain disposed in the closed condition. The one or more shear pins are provided to secure the flow control member to the wellbore string so that the passage 16 is maintained fluidically isolated from the reservoir until it is desired to treat the reservoir with treatment material. To effect the initial displacement of the flow control member 14 from the first position to the second position, sufficient force must be applied to the one or more shear pins such that the one or more shear pins become sheared, resulting in the flow control member 14 becoming displaceable relative to the port 18. In some operational implementations, the force that effects the shearing is applied by a workstring (see below).

In some embodiments, for example, the displacement forces are applied to the flow control member 14 mechanically, hydraulically, or a combination thereof. In some embodiments, for example, the applied forces are mechanical forces, and such forces are applied by one or more shifting tools. In some embodiments, for example, the applied forces are hydraulic, and are applied by a pressurized fluid.

Referring to FIGS. 1 to 7, 7A, and 7B in some embodiments, for example, the apparatus 10 includes a hard stop engager 32, and the flow control member 14 is configured for becoming coupled to the hard stop engager 32 during the displacement of the flow control member 14 relative to the port 18. In some embodiments, for example, the hard stop engager carries a snap-ring 34. In this respect, the flow control member 14 includes a receiving recess 37 for receiving the snap-ring 34 when the receiving recess becomes aligned with the snap-ring. Such alignment is configured to be effected after the flow control member 14 has become unlocked relative to the housing 12, and has become displaced from its original position while locked (i.e. the first position).

As discussed above, the flow control member 14 is displaceable, relative to the port 18, from the first position, corresponding to disposition of the port 18 in the closed condition, to the second position, corresponding to disposition of the port 18 in the open condition. Prior to being coupled to the hard stop engager 32, the displacement of the flow control member 14, relative to the port 18, is limited between these positions, by the hard stops 36, 38.

In some embodiments, for example, the displacement of the flow control member 14, relative to the port 18, is only effectible after the flow control member 14 becomes unlocked from the housing 12. In this respect, while the flow control member 14 is locked to the housing 12, the flow control member 14 is uncoupled from the hard stop engager 32. In some embodiments, while locked to the housing 12, the flow control member 14 is positioned in the first position such that the port 14 is disposed in the closed condition, and the displacement of the flow control member 14, relative to the port 18, is only effectible after the flow control member 14 becomes unlocked from the housing 12 and displaced from the first position.

In some embodiments, after unlocking of the flow control member 14, the flow control member 14 is displaceable, relative to the port 18, from the first position, corresponding to disposition of the port in the closed condition, and to the second position, corresponding to disposition of the port 18 in the open condition, prior to the coupling of the flow control member 14 to the hard stop engager 32.

The coupling of the flow control member 14 to the hard stop engager 32 is such that, while the flow control member 14 is coupled to the hard stop engager 32, the hard stop engager 32 translates with the flow control member 14, and the displacement of the flow control member 14, relative to the port 18, becomes limited by the hard stop 40, in response to engagement of the hard stop engager 32 with the hard stop 40. In this respect, upon the engagement of the hard stop engager 32 with the hard stop 40, the flow control member 14 becomes disposed, relative to the port 18 in a position corresponding to the disposition of the port 18 in the screened condition.

Referring to FIGS. 1 to 3, 7A and 7B in some embodiments, for example, upon the coupling of the flow control member 14 with the hard stop engager 32, the flow control member 14 is restricted from returning to the first position (i.e. that position corresponding to disposition of the port 18 in the closed condition). In some of these embodiments, for example, where the hard stop engager 32 carries a snap-ring 34, while the flow control member 14 is locked to the housing 12, the snap-ring 34 is disposed downhole relative to the receiving recess 37 (that is configured to receive the snap-ring 34 when alignment is effected between the snap-ring 34 and the receiving recess 36). In this respect, after the unlocking of the flow control member 14 from the housing 12, downhole displacement of the flow control member 14 from the first position to the second position (to effect opening of the port 18) effects the alignment, resulting in coupling of the flow control member 14 to the hard stop engager 32. Because the coupling of the hard stop engager 32 to the flow control member 14 is effected as the flow control member 14 is displaced downhole from the first position to the second position to effect opening of the port 18, the flow control member 14 can now no longer return, by uphole displacement, to re-close the port 18, due to the interference provided by the hard stop 40 to the uphole displacement of the hard stop engager 32. Instead, in response to uphole displacement of the flow control member 14 from the second position, the flow control member 14 stops short of the first position upon the hard stop engager 32 engaging the hard stop 40, and the flow control member 14 becomes disposed, relative to the port 18, in a position corresponding to the disposition of the port 18 in the screened condition.

Referring to FIGS. 4 to 7, 7A and 7B in some embodiments, for example, upon the coupling of the flow control member 14 with the hard stop engager 32, the flow control member 14 is restricted from returning to the second position (i.e. that position corresponding to disposition of the port 18 in the open condition). In some of these embodiments, for example, where the hard stop engager 32 carries a snap-ring 34, while the flow control member 14 is locked to the housing 12, the snap-ring 34 is disposed uphole relative to the receiving recess 37 (that is configured to receive the snap-ring 34 when alignment is effected between the snap-ring 34 and the receiving recess 37), such that, after the unlocking of the flow control member 14 from the housing 12, the alignment is only effected by uphole displacement of the flow control member 14. So, if the initial displacement of the flow control member 14, upon the unlocking of the flow control member 14, is in the downhole direction to the second position, for effecting opening of the port 18 (such as, for example, to enable supplying of hydraulic fracturing fluid through the port 18), the alignment, and the resultant coupling, is only effected once the flow control member 14, after having opened the port 18, is displaced in an uphole direction to re-close the port 18. In order to effect the alignment, and the resultant coupling, the uphole displacement of the flow control member 14 is such that the flow control member 14 becomes displaced slightly uphole relative to its position when previously locked to the housing 12 (in this context, such position is considered to be a "first position", as the port 18 is closed when the flow control member 14 is disposed in this position), the uphole displacement being limited by the stop 38. Because the coupling of the hard stop engager 32 to the flow control member 14 is effected as the flow control member 14 is displaced uphole from the second position to the first position to effect re-closing of the port 18, the flow control member 14 can now no longer return, by downhole displacement, to the second position, such that the port 18 becomes disposed in the open condition, due to the interference provided by the hard stop 40 to the downhole displacement of the hard stop engager 32. Instead, in response to downhole displacement of the flow control member 14, after the flow control member 14 becomes coupled to the hard stop engager 32, the flow control member 14 stops short of the second position upon the hard stop engager 32 engaging the hard stop 40, and the flow control member 14 becomes disposed, relative to the port 18, in a position corresponding to the disposition of the port 18 in the screened condition.

In some embodiments, for example, the hard stop engager 32 is disposed within the passage 16, between the flow control member 14 and the housing 12. In some embodiments, for example, the hard stop engager 32 is in the form of a sleeve.

Figure 8:
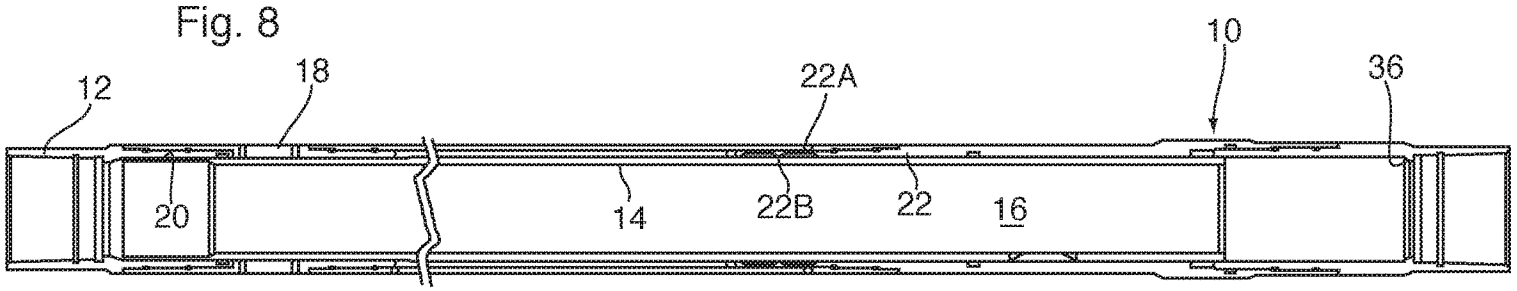
FIG. 8 is a sectional view of a third embodiment of the apparatus, showing the port disposed in the closed condition.
Figure 11:
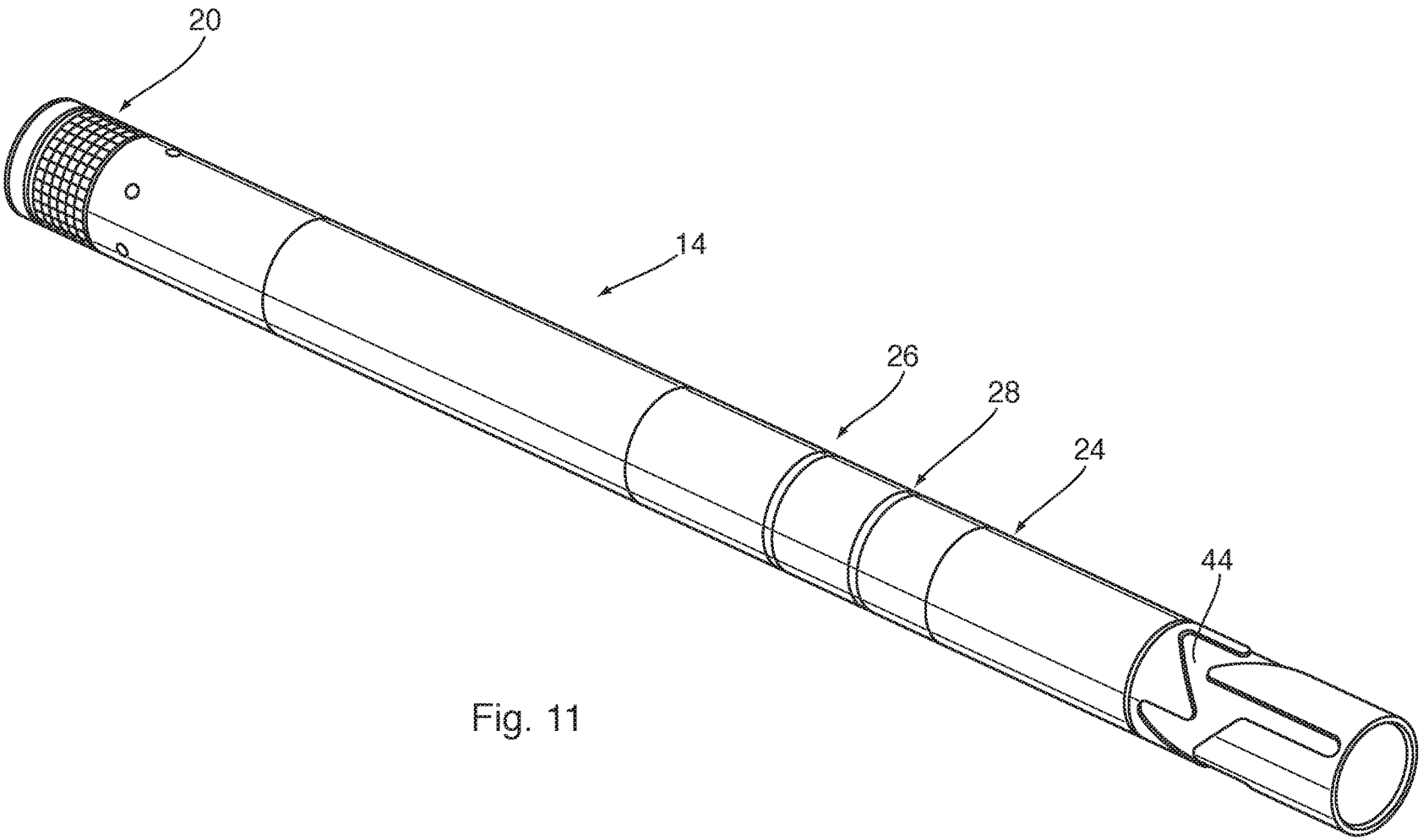
FIG. 11 is a perspective view of the flow control member that is useable with the third embodiment (see FIGS. 8, 9 and 10) of the apparatus.
Figure 12:
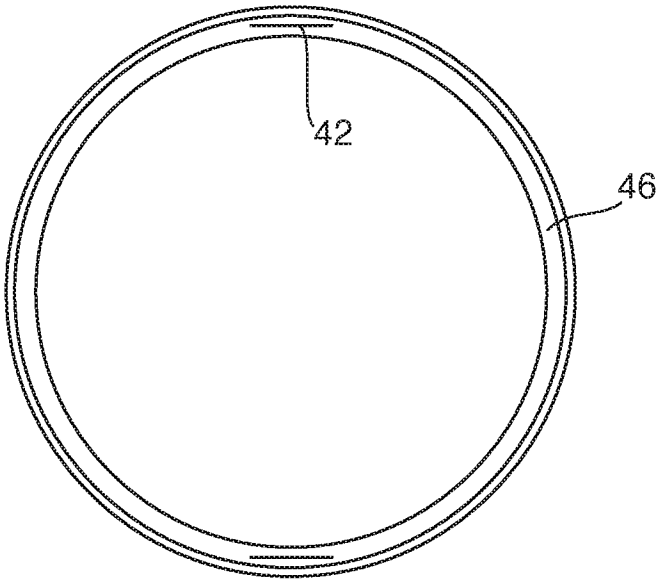
FIG. 12 is an end view of one end of the clutch ring of the apparatus illustrated in FIG. 8.
Figure 13:
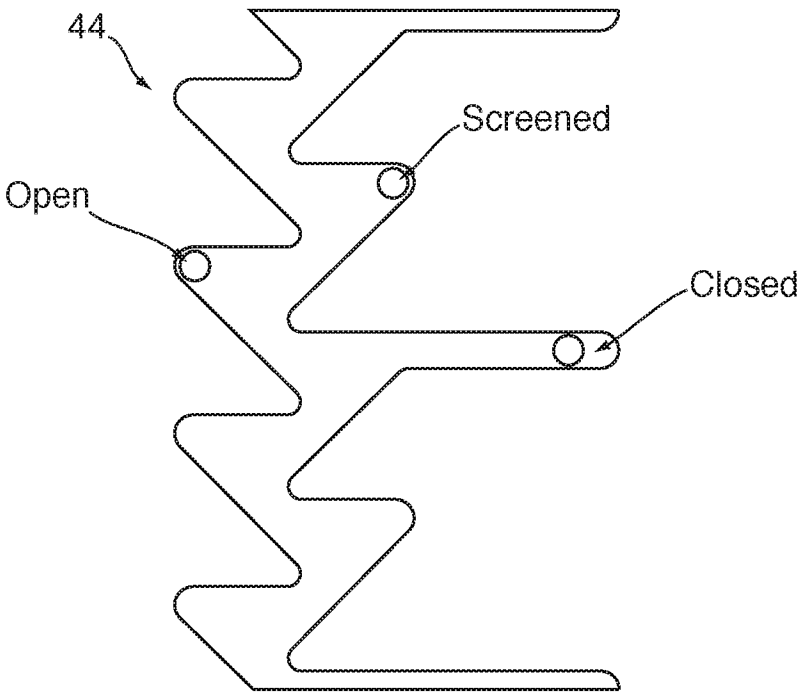
FIG. 13 is an unwrapped view of a J-slot profile of the flow control member of the apparatus illustrated in FIG. 8.

In some embodiments, for example, and referring to FIGS. 8 to 10, the housing 12 includes a hard stop 42 and the flow control member 14 includes a j-slot 44 (see FIGS. 11 and 13). In some embodiments, the j-slot 44 is provided in the external surface of the flow control member 14. The hard stop 42 is disposed for displacement, relative to the flow control member 14, within the j-slot 44, while the flow control member 14 is being displaced, relative to the port 18, and co-operates with the j-slot such that displacement of the flow control member 14 is limited such that at least one of the first, second and third positions of the flow control member 14, relative to the port 18, is established by the limiting of the displacement of the flow control member 14 by the interaction between the hard stop 42 and the j-slot 44 (see FIG. 13).

In some embodiments, for example, the hard stop 42 includes one or more pins depending from a clutch ring 46 (see FIG. 12) that is integrated within the housing 12 and is rotationally independent from the housing 12. Each one of the one or more pins are disposed within the j-slot 44 for travel within the j-slot. Positions of the hard stop 42 within the j-slot 44, and corresponding to each one of the open, closed and screened positions, is illustrated in FIG. 13.

In some embodiments, for example, while the apparatus 10 is being deployed downhole, the flow control member 14 is maintained in a position, by one or more shear pins (not shown), such that the port 18 remain disposed in the closed condition, as described above.

In the embodiments illustrated in FIGS. 1 to 10, the flow control member 14 is displaceable between the first, second and third positions by application of a force (such as, for example, a mechanical force, a hydraulic force, or a combination of a mechanical and a hydraulic force) to the flow control member 14. In some embodiments, for example, the applied force is a mechanical force, and such force is applied by a shifting tool. In some embodiments, for example, the applied force is hydraulic, and is applied by a pressurized fluid.

In some of those embodiments illustrated in FIGS. 1 to 3, in some of those embodiments illustrated in FIGS. 4 to 7, and in some of those embodiments illustrated in FIGS. 8 to 10, for example, all of the displacement forces are imparted by a shifting tool, and the shifting tool is integrated within a bottom hole assembly that includes other functionalities. The bottomhole assembly may be deployed within the wellbore on a workstring. Suitable workstrings include tubing string, wireline, cable, or other suitable suspension or carriage systems. Suitable tubing strings include jointed pipe, concentric tubing, or coiled tubing. The workstring includes a fluid passage, extending from the surface, and disposed in, or disposable to assume, fluid communication with the fluid conducting structure of the tool. The workstring is coupled to the bottomhole assembly such that forces applied to the workstring are translated to the bottomhole assembly to actuate movement of the flow control member 14. All of the displacement forces are impartable in such embodiments by a shifting tool that is actuable by a workstring because, for amongst other reasons, each one of the first, second, and third positions are determined by a respective hard stop, and which, therefore, facilitates the positioning of the flow control member 14 such that positioning of flow control member is not entirely dependent on the manipulation of the shifting tool.

Figure 14:
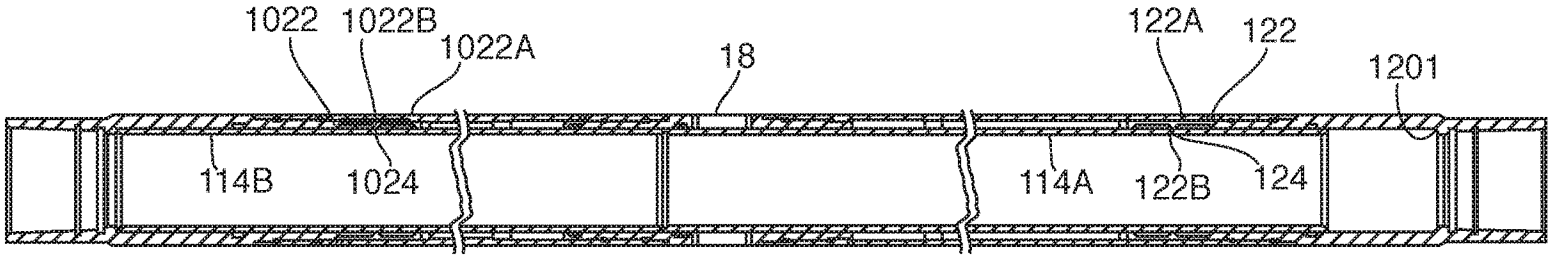
FIG. 14 is a sectional view of a fourth embodiment of the apparatus, showing the port disposed in the closed condition.
Figure 15:
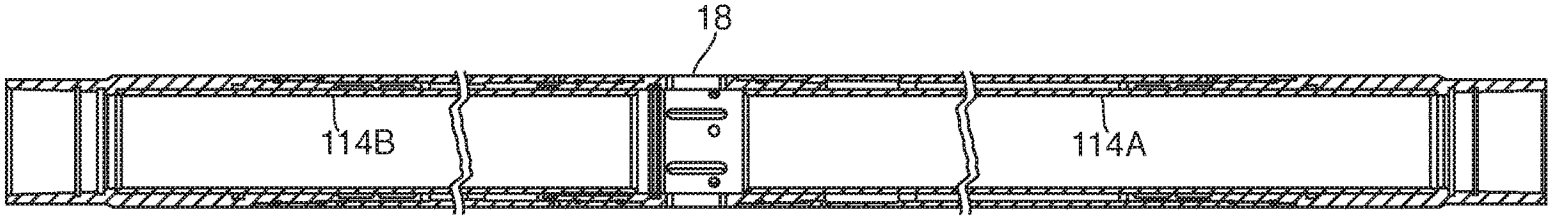
FIG. 15 is a sectional view of the apparatus illustrated in FIG. 15, showing the port disposed in the open position.
Figure 16:
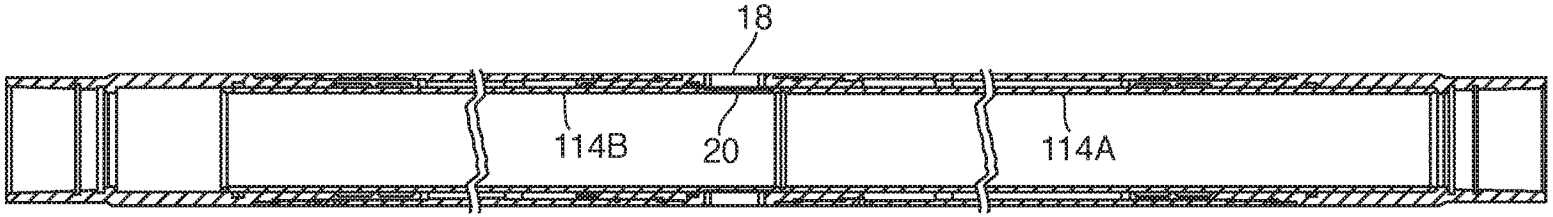
FIG. 16 is a sectional view of the apparatus illustrated in FIG. 15, showing the port disposed in the screened position.

Referring to FIGS. 14 to 16, in some embodiments, for example, rather than having flow control member 14, the apparatus 10 includes first and second flow control members 114A, 114B. The flow control member 114B includes the screen 20.

The first flow control member 114A is displaceable from a closed port condition-defining position to a non-closed port condition-defining position. The second flow control member 114B is positionable in a screened port condition-defining position.

The first flow control member 114A co-operates with the second flow control member 114B such that: (i) disposition of the first flow control member 114A in the closed port condition-defining position is conditional on the second flow control member 114B being disposed in a retracted position relative to the screened port condition-defining position, and the disposition of the first flow control member 114A in the closed port condition-defining position corresponds to the port 18 being disposed in the closed condition, (ii) disposition of the second flow control member 114B in the screened port condition-defining position is conditional on the first flow control member 114A being disposed in a retracted position relative to the closed port condition-defining position, and the disposition of the second flow control member 114B in the screened port condition-defining position corresponds to the port 18 being disposed in the screened condition, and (iii) while the first flow control member 114A is disposed in the non-closed port condition-defining position and the second flow control member 114B is disposed in a retracted position relative to the screened port condition-defining position, the port 18 is disposed in an open condition. The closed, open and screened conditions of the port 18 are as above-described.

In some embodiments, for example, the first flow control member 114A is disposed one of uphole or downhole relative to the second flow control member 114B. In this respect, in some of these embodiments, for example, the first flow control member 114A co-operates with the second flow control member 114B such that: (i) disposition of the first flow control member 114A in the closed port condition-defining position is conditional on the second flow control member 114B being disposed in a retracted position relative to the screened port condition-defining position in a direction that is the other one of uphole or downhole (in the illustrated embodiment, this is in the uphole direction), and the disposition of the first flow control member 114A in the closed port condition-defining position corresponds to the port 18 being disposed in the closed condition; (ii) disposition of the second flow control member 114B in the screened port condition-defining position is conditional on the first flow control member 114A being disposed in a retracted position relative to the closed port condition-defining position in a direction that is the one of uphole or downhole (in the illustrated embodiment, this is in the downhole direction), and the disposition of the second flow control member 114B in the screened port condition-defining position corresponds to the port 18 being disposed in the screened condition, and (iii) while the first flow control member 114A is disposed in the non-closed port condition-defining position and the second flow control member 114B is disposed in a retracted position relative to the screened port condition-defining position in a direction that is the other one of uphole or downhole (in the illustrated embodiment, this is in the uphole direction), the port 18 is disposed in an open condition.

In some embodiments, for example, a flow control member-engaging collet 122 extends from the housing 12, and is configured to engage the flow control member 114A for resisting a change in disposition of the flow control member. In this respect, in some embodiments, for example, the flow control member-engaging collet 122 includes at least one resilient flow control member-engaging collet finger 122A, and each one of the at least one flow control member-engaging collet finger includes a tab 122B that engages the flow control member. The flow control member 114A and the flow control member-engaging collet 122 are co-operatively configured so that engagement of the flow control member and the flow control member-engaging collet is effected while the flow control member 114A is disposed in the closed port condition-defining position or the non-closed port condition-defining position.

Referring to FIG. 14, while the flow control member 114A is disposed in the closed port condition-defining position (i.e. the port 18 is disposed in the closed condition) the flow control member-engaging collet 122 is engaging the flow control member 114A such that interference or resistance is being effected to displacement of the flow control member. The flow control member 114A includes a closed condition-defining recess 124. The at least one flow control member-engaging collet finger 122A and the recess 124 are co-operatively configured such that while the flow control member 114A is disposed in the closed port condition-defining position, the flow control member-engaging collet finger tab 122B is disposed within the closed condition-defining recess 124. In order to effect displacement of the first flow control member 114A from the closed port condition-defining position to the non-closed port condition-defining position, and thereby effect opening of the port 18, a FCM ("first flow control member) displacement force is applied to the flow control member 114A to effect displacement of the tab 122B from (or out of) the recess 124. Such displacement is enabled due to the resiliency of the collet finger 122A. Once the flow control member-engaging collet finger tab 122B has become displaced out of the recess 124, continued application of force to the flow control member 114A (such as, in the illustrated embodiment, in a downhole direction) effects displacement of the flow control member 114A, relative to the port 18, such that there is a change in condition of the port 18 from a closed condition to an open condition (see FIG. 15).

Referring to FIG. 15, upon becoming disposed in the non-closed port condition-defining position, the flow control member-engaging collet 122 engages the flow control member 114A such that interference or resistance is being effected to displacement of the flow control member, relative to the port 18, from the non-closed port condition-defining position. The flow control member 114A includes a non-closed condition-defining recess 126. The at least one flow control member-engaging collet finger 122A and the recess 124 are co-operatively configured such that while the flow control member 114A is disposed in the non-closed port condition-defining position (such that the port 18 is disposed in the open condition), the flow control member-engaging collet finger tab 122B is disposed within the non-closed condition-defining recess 126.

In some embodiments, for example, a flow control member-engaging collet 1022 extends from the housing 12, and is configured to engage the flow control member 114B for resisting displacement of the flow control member 14 relative to the port 18. In this respect, in some embodiments, for example, the flow control member-engaging collet 1022 includes at least one resilient flow control member-engaging collet finger 1022A, and each one of the at least one flow control member-engaging collet finger includes a tab 1022B that engages the flow control member 114B. The flow control member 114B and the flow control member-engaging collet 1022 are co-operatively configured so that engagement of the flow control member 14 and the flow control member-engaging collet 1022 is effected while the flow control member 114B is disposed in a retracted position relative to the screened port condition-defining position.

Referring to FIG. 15, while the flow control member 114B is disposed in a retracted position, relative to screened port condition-defining position, the flow control member-engaging collet 1022 is engaging the flow control member 114B such that interference or resistance is being effected to displacement of the flow control member. The flow control member 114B includes a retracted condition-defining recess 1024. The at least one flow control member-engaging collet finger 1022A and the recess 1024 are co-operatively configured such that while the flow control member 114B is disposed in the retracted position, relative to screened port condition-defining position, the flow control member-engaging collet finger tab 1022B is disposed within the retracted condition-defining recess 1024. While the flow control member 114A is disposed in a retracted position, relative to the closed port condition-defining position (such as, for example, while the flow control member 114A is disposed in the non-closed port condition-defining position), and while the flow control member 114B is disposed in the retracted position, relative to screened port condition-defining position, the flow control member 114B is displaceable to the screened port condition-defining position. In order to effect displacement of the first flow control member 114B from the retracted position, relative to screened port condition-defining position, to the screened port condition-defining position, and thereby effect disposition of the port 18 in a screened condition, a SCM ("second flow control member") displacement force is applied to the flow control member 114B to effect displacement of the tab 1022B from (or out of) the recess 1024. Such displacement is enabled due to the resiliency of the collet finger 1022A. Once the flow control member-engaging collet finger tab 1022B has become displaced out of the recess 1024, continued application of force to the flow control member 114B (such as, in the illustrated embodiment, in a downhole direction) effects displacement of the flow control member 114B such that there is a change in condition of the port 18 from the open condition to the screened condition (see FIG. 16).

Referring to FIG. 16, upon the flow control member 114B becoming disposed in the screened port condition-defining position, the flow control member-engaging collet 1022 engages the flow control member 114B such that interference or resistance is being effected to displacement of the flow control member 14 from the second port condition-defining position. The flow control member 114B includes a screened condition-defining recess 1026. The at least one flow control member-engaging collet finger 1022A and the recess 1026 are co-operatively configured such that while the flow control member 114B is disposed in the screened port condition-defining position (such that the port 18 is disposed in the screened condition), the flow control member-engaging collet finger tab 1022B is disposed within the screened condition-defining recess 1026.

Referring to FIG. 16, in some embodiments, while the flow control member 114A is disposed in the non-closed port condition-defining position, the flow control member 114A functions as a hard stop, limiting displacement of the flow control member 114B, from the screened port condition-defining position, in a direction that is the one of uphole or downhole (in the illustrated embodiment, this is in the downhole direction) from the screened port condition-defining position. In some of these embodiments, for example, the housing defines a hard stop 1201 for limiting displacement of the flow control member 114A, while the flow control member 114A is disposed in the non-closed port condition-defining position, in a direction that is the one of uphole or downhole (in the illustrated embodiment, this is in the downhole direction) from the non-closed port condition-defining position.

Referring to FIG. 14, in some embodiments, while the flow control member 114B is disposed in the retracted position, relative to screened port condition-defining position, the flow control member 114B functions as a hard stop, limiting displacement of the flow control member 114A, from the closed port condition-defining position, in a direction that is the other one of uphole or downhole (in the illustrated embodiment, this is in the uphole direction) from the closed port condition-defining position. In some of these embodiments, for example, the housing defines a hard stop 1203 for limiting displacement of the flow control member 114B, while the flow control member 114B is disposed in a retracted position, relative to the screened port condition-defining position, in a direction that is the other one of uphole or downhole (in the illustrated embodiment, this is in the uphole direction) from the retracted position.

In some embodiments, for example, while the apparatus 10 is being deployed downhole, the flow control member 114A is maintained in a position, by one or more shear pins (not shown), such that the port 18 remain disposed in the closed condition, as described above.

Each one of the flow control members 114A, 114B is displaceable by application of a force (such as, for example, a mechanical force, a hydraulic force, or a combination of a mechanical and a hydraulic force) to the flow control member 14. In some embodiments, for example, the applied force is a mechanical force, and such force is applied by a shifting tool, such as one that is integrated within a bottom-hole assembly (as above-described). In some embodiments, for example, the applied force is hydraulic, and is applied by a pressurized fluid.

Upon the apparatus 10 being deployed downhole to a desired location, the flow control member 114A is disposed in the closed port condition-defining position and the flow control member 114B is disposed in a retracted position relative to screened port condition-defining position. To effect opening of the port 18, a FCM displacement force is applied to the flow control member 114A, resulting in displacement of tab 122B from the recess 124. While continuing to apply the FCM displacement force, displacement of the flow control member 114A, relative to the port 18, is effected from the closed port condition-defining position until the flow control member becomes disposed in contact engagement with the hard stop 1201. Upon becoming disposed in contact engagement with the hard stop 1201, the flow control member 114A is disposed in the non-closed port condition-defining position. The port 18 is now in the open condition, and hydraulic fracturing fluid may be supplied into the subterranean formation through the port 18.

After the supplying of the hydraulic fracturing fluid has finished such that the supplying has become suspended, the port 18 can be reclosed by shifting the flow control member 114A to the closed port condition-defining position, or the port 18 can be transitioned to the screened condition, thereby enabling production.

To transition the port 18 to the screened condition, the flow control member 114B is shifted to the screened port condition-defining position. In order to transition the port 18 to the screened condition, a SCM displacement force is applied to the flow control member 114B, resulting in displacement of tab 1022B from the recess 1026. While continuing to apply the SCM displacement force, displacement of the flow control member 114B is effected from the retracted position, relative to screened port condition-defining position, until the flow control member 114B becomes disposed in contact engagement with the flow control member 114A, which limits further displacement of the flow control member 114B. Upon becoming disposed in contact engagement with the flow control member 114A, the flow control member 114B is disposed in the screened port condition-defining position. The port 18 is now in the screened condition such that fluid communication is effected between the wellbore and the subterranean formation, enabling production of reservoir fluids, while still preventing entry of oversize solids into the wellbore during such production. In this respect, the flow control member 114A functions as a hard stop, defining the screened port condition-defining position of the flow control member 114A.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. An apparatus comprising:

a housing including a port, a screened position-determining hard stop, and a passage;

a flow control member including a screen, wherein the flow control member is displaceable relative to the port; and a hard stop engager disposed between the flow control member and the housing for coupling with the flow control member;

wherein the flow control member and the hard stop engager are co-operatively configured such that:

(i) while there is an absence of coupling between the flow control member and the hard stop engager, the flow control member is displaceable relative to the port between a closed position, corresponding to disposition of the port in a closed condition, and an open position, corresponding to disposition of the port in an open condition;

(ii) while the flow control member is being displaced from one of the open position and the closed position, the hard stop engager becomes coupled to the flow control member for displacement with the flow control member; and (iii) while the hard stop engager is coupled to the flow control member, a screened position of the flow control member becomes determinable by the screened position-determining hard stop, wherein the screened position corresponds to disposition of the flow control member relative to the port such that at least a portion of the screen is disposed in alignment with the port such that the port is obstructed, or substantially obstructed by the at least a portion of the screen.

2. The apparatus as claimed in claim 1;

wherein the disposition of the flow control member in the open position is such that a continuous portion of the port is unobstructed by the flow control member, wherein the continuous portion defines at least 25% of the total area of the port.

3. The apparatus as claimed in claim 1;

wherein the disposition of the flow control member in the open position is such that the port is non-occluded, or substantially non-occluded, by the flow control member.

4. The apparatus as claimed in claim 1;

wherein the disposition of the flow control member in the closed position is such that the flow control member occludes the port.

5. The apparatus as claimed in claim 1;

wherein the flow control member and the hard stop engager are co-operatively configured such that, while the flow control member is coupled to the hard stop engager, the flow control member is restricted from returning to the closed position.

6. The apparatus as claimed in claim 1;

wherein the flow control member and the hard stop engager are co-operatively configured such that, while the flow control member is coupled to the hard stop engager, the flow control member is restricted from returning to the open position.

7. The apparatus as claimed in claim 1;

wherein the flow control member is releasably locked to the housing for preventing, or substantially preventing, displacement of the flow control member relative to the port, such that, after unlocking of the flow control member from the housing, the displaceability of the flow control member, relative to the port, is effected.

8. The apparatus as claimed in claim 7;

wherein the port is disposed in the closed condition while the flow control member is locked to the housing.

9. The apparatus as claimed in claim 1;

wherein the flow control member includes a first sleeve that is slidably disposed within the housing for displacement within the passage.

10. The apparatus as claimed in claim 1;

wherein the hard stop engager includes a second sleeve that is slidably disposed within the housing for displacement within the passage.

11. The apparatus as claimed in claim 1;

wherein:

the flow control member includes a recess; and the coupling of the hard stop engager to the flow control member is effectible when the recess becomes aligned with the hard stop engager.

12. The apparatus as claimed in claim 11;

wherein the hard stop engager includes a snap ring biased for outward displacement, for becoming disposed within the recess and effecting coupling of the hard stop engager to the flow control member when the recess becomes aligned with the hard stop engager.

13. The apparatus as claimed in claim 12;

wherein:

the flow control member is releasably locked to the housing for preventing, or substantially preventing, displacement of the flow control member relative to the port, such that, after unlocking of the flow control member from the housing, the displaceability of the flow control member, relative to the port, is effected;

and the snap ring is disposed downhole relative to the recess such that downhole displacement of the flow control member from the closed position to the open position effects the disposition of the snap ring within the recess, such that, once disposition of the snap ring within the recess is effected, uphole displacement of the flow control member from the open position to the closed position is prevented.

14. The apparatus as claimed in claim 13;

wherein the uphole displacement of the flow control member from the open position to the closed position is prevented by interaction of the snap ring with the screened position-determining hard stop.

15. The apparatus as claimed in claim 12;

wherein:

the flow control member is releasably locked to the housing for preventing, or substantially preventing, displacement of the flow control member relative to the port, such that, after unlocking of the flow control member from the housing, the displaceability of the flow control member, relative to the port, is effected;

and the snap ring is disposed uphole relative to the recess such that uphole displacement of the flow control member from the open position effects the disposition of the snap ring within the recess, such that, once disposition of the snap ring within the recess is effected, downhole displacement of the flow control member from the closed position to the open position is prevented.

16. The apparatus as claimed in claim 15;

wherein the downhole displacement of the flow control member from the closed position to the open position is prevented by interaction of the snap ring with the screened position-determining hard stop.

17. An apparatus comprising:

a housing including a port, a hard stop, and a passage;

a flow control member including a screen and a j-slot;

wherein:

the flow control member is displaceable, relative to the port, such that the flow control member is positionable, relative to the port, in a first position, corresponding to disposition of the port in a closed condition, a second position, corresponding to disposition of the port in an open condition, and a third position, corresponding to disposition of the port in a screened condition, wherein, in the screened condition, at least a portion of the screen is disposed in alignment with the port such that the port is obstructed, or substantially obstructed by the at least a screen portion, and such that the at least a screen portion is disposed for interfering with conduction of oversize solids through the port;

the hard stop is disposed within the j-slot and is displaceable, relative to the flow control member, while the flow control member is being displaced, relative to the port, and co-operates with the j-slot such that displacement of the flow control member is limited such that each one of the first, second and third positions of the flow control member is established by the limiting of the displacement of the flow control member by the interaction between the hard stop and the j-slot.

18. The apparatus as claimed in claim 17;

wherein the disposition of the flow control member in the second position is such that a continuous portion of the port is unobstructed by the flow control member, wherein the continuous portion defines at least 25% of the total area of the port.

19. The apparatus as claimed in claim 17;

wherein disposition of the flow control member in the second position is such that the port is non-occluded, or substantially non-occluded, by the flow control member.

20. The apparatus as claimed in claim 17;

wherein the disposition of the flow control member in the first position is such that the flow control member occludes the port.

21. The apparatus as claimed in claim 17;

wherein the flow control member is releasably locked to the housing for preventing, or substantially preventing, displacement of the flow control member relative to the port, such that, after unlocking of the flow control member from the housing, the displaceability of the flow control member, relative to the port, is effected.

22. The apparatus as claimed in claim 21;

wherein the port is disposed in the closed condition while the flow control member is locked to the housing.

23. The apparatus as claimed in claim 17;

wherein the flow control member includes a first sleeve that is slidably disposed within the housing for displacement within the passage.

24. The apparatus as claimed in claim 17;

wherein the hard stop includes a second sleeve that is slidably disposed within the housing for displacement within the passage.

25. The apparatus as claimed in claim 17;

wherein the interaction between the hard stop and the j-slot includes interaction between the hard stop and a terminus of the j-slot.

26. An apparatus comprising:

a housing including a port and a passage;

a first flow control member displaceable relative to the port between a closed port condition-defining position and a non-closed port condition-defining position; and a second flow control member including a screen, wherein the second flow control member is displaceable independently of the first flow control member, relative to the port, and positionable in a screened port condition-defining position;

wherein the first flow control member co-operates with the second flow control member such that:

(i) disposition of the first flow control member in the closed port condition-defining position is conditional on the second flow control member being disposed in a retracted position relative to the screened port condition-defining position, and the disposition of the first flow control member in the closed port condition-defining position corresponds to the port being disposed in the closed condition, (ii) disposition of the second flow control member in the screened port condition-defining position is conditional on the first flow control member being disposed in a retracted position relative to the closed port condition-defining position, and the disposition of the second flow control member in the screened port condition-defining position corresponds to the port being disposed in the screened condition, and (iii) while the first flow control member is disposed in the non-closed port condition-defining position and the second flow control member is disposed in a retracted position relative to the screened port condition-defining position, the port is disposed in an open condition.

27. The apparatus as claimed in claim 26;

wherein, while the apparatus is deployed within a wellbore, the first flow control member is disposed in one of uphole or downhole relative to the second flow control member;

and wherein the first flow control member co-operates with the second flow control member such that:

(i) disposition of the first flow control member in the closed port condition-defining position is conditional on the second flow control member being disposed in a retracted position relative to the screened port condition-defining position in a direction that is the other one of uphole or downhole;

(ii) disposition of the second flow control member in the screened port condition-defining position is conditional on the first flow control member being disposed in a retracted position relative to the closed port condition-defining position in a direction that is the one of uphole or downhole, and the disposition of the second flow control member in the screened port condition-defining position corresponds to the port being disposed in the screened condition, and (iii) while the first flow control member is disposed in the non-closed port condition-defining position and the second flow control member is disposed in a retracted position relative to the screened port condition-defining position in a direction that is the other one of uphole or downhole, the port is disposed in an open condition.

28. The apparatus as claimed in claim 27;

wherein the first flow control member further co-operates with the second flow control member such that, while the first flow control member is disposed in the non-closed port condition-defining position, the first flow control member limits displacement of the second flow control member, from the screened port condition-defining position, in a direction that is the one of uphole or downhole from the screened port condition-defining position.

29. The apparatus as claimed in claim 27;

wherein the disposition of the port in the open condition is such that a continuous portion of the port is unobstructed by the flow control members, wherein the continuous portion defines at least 25% of the total area of the port.

30. The apparatus as claimed in claim 27;

wherein the disposition of the port in the open condition is such that the port is non-occluded, or substantially non-occluded, by the flow control members.

31. The apparatus as claimed in claim 30;

wherein the disposition of the port in the closed condition is such that the first flow control member occludes the port.

32. An apparatus comprising:

a housing including a port, and a passage;

a flow control member, wherein the flow control member is displaceable relative to the port;

a hard stop engager disposed between the flow control member and the housing for coupling with the flow control member;

wherein the flow control member and the hard stop engager are cooperatively configured such that:

(i) while the flow control member is displaced relative to the port the hard stop engager becomes coupled to the flow control member for displacement with the flow control member; and (ii) while the hard stop engager is coupled to the flow control member, the hard stop engager is operative for limiting displacement of the flow control member relative to the housing.

33. The apparatus as claimed in claim 32;

wherein:

the flow control member includes a recess; and the coupling of the hard stop engager to the flow control member is effectible when the recess becomes aligned with the hard stop engager.

34. The apparatus as claimed in claim 33;

wherein the hard stop engager includes a snap ring biased for outwardly displacement, for becoming disposed within the recess and effecting coupling of the hard stop engager to the flow control member when the recess becomes aligned with the hard stop engager.

35. The apparatus as claimed in claim 32;

wherein the flow control member includes a first sleeve that is slidably disposed within the housing for displacement within the passage.

36. The apparatus as claimed in claim 32;

wherein the hard stop engager includes a second sleeve that is slidably disposed within the housing for displacement within the passage.

* * * * *